US006056830A

United States Patent [19]

Honkura et al.

[11] Patent Number: 6,056,830

[45] Date of Patent: May 2, 2000

[54] ANISOTROPIC MAGNET POWDERS AND THEIR PRODUCTION METHOD

[75] Inventors: Yoshinobu Honkura, Chita-gun; Chisato Mishima, Chita; Hironari Mitarai, Tokai, all of Japan

[73] Assignee: Aichi Steel Works, Ltd., Tokai, Japan

[21] Appl. No.: 08/947,340

[22] Filed: Oct. 8, 1997

[30] Foreign Application Priority Data

Oct. 28, 1996 [JP] Japan ..... 8-285597

[51] Int. Cl.[7] ..... H01F 1/057

[52] U.S. Cl. ..... 148/122; 148/101

[58] Field of Search ..... 148/101, 105, 148/122

[56] References Cited

U.S. PATENT DOCUMENTS

| | | | |
|---|---|---|---|
| 5,110,374 | 5/1992 | Takeshita et al. | 148/101 |
| 5,127,970 | 7/1992 | Kim . | |
| 5,221,368 | 6/1993 | Gabriel et al. . | |
| 5,338,371 | 8/1994 | Nakayama et al. | 148/101 |
| 5,417,773 | 5/1995 | Nakayama et al. | 148/101 |
| 5,656,100 | 8/1997 | Yamamato et al. | 148/302 |

FOREIGN PATENT DOCUMENTS

| | | |
|---|---|---|
| 0 576 055 | 12/1993 | European Pat. Off. . |
| 0 595 477 | 5/1994 | European Pat. Off. . |
| 0 633 582 | 1/1995 | European Pat. Off. . |
| 62-23903 | 1/1987 | Japan . |
| 4-20242 | 4/1992 | Japan . |
| 7-68561 | 7/1995 | Japan . |
| 9-251912 | 9/1997 | Japan . |

OTHER PUBLICATIONS

Journal of Alloys and Compounds 231 (1995) 51–59 "Some applications of hydrogenation–decomposition–desorption–recombination (HDDR) and hydrogen–decrepitation (HD) in metals processing".

J. Appl. Phys. 79(8), Apr. 15, 1996, 1996 American Institute of Physics. "Anisotropic Nd–Fe–B bonded magnets made from HDDR powder (invited)".

*Primary Examiner*—John Sheehan

*Attorney, Agent, or Firm*—Jacobson, Price, Holman & Stern, PLLC

[57] ABSTRACT

A rare earth permanent magnet powder having high anisotropy, that means Br/Bs of more than 0.65, is produced by applying present invented hydrogen heat treatment. The rare earth permanent magnet powder consists essentially of rare earth element including yttrium, iron, and boron. It is subjected to hydrogen heat treatment accompanied with phase transformations. The treatment is carried out at the relative reaction rate within the range of 0.25–0.50 at 830° C. and hydrogen pressure of 0.1 MPa. Here the relative reaction rate is defined as the ratio of actual reaction rate to the standard reaction rate which measured at the temperature of 830° C. and hydrogen pressure of 0.1 MPa.

6 Claims, 2 Drawing Sheets

ANISOTROPIC MAGNET POWDERS AND THEIR PRODUCTION METHOD

BACKGROUND OF THE INVENTION

1. Technical Field

The present invention relates to anisotropic magnet powders which consist of rare earth element, iron and boron and also relates to its production method.

2. Prior Art

RFeB type rare earth magnet which is mainly composed of rare earth element including yttrium (Y), iron (Fe) and boron (B) is widely used in industry due to excellent magnetic properties. There are three patents related to the present invention, namely, Japanese Patent Application Laid-open (Kokai) No.60-257107, 62-23903 and Japanese Examined Patent Publication (Kokoku) No.7-68561.

Japanese Patent Application Laid-open (Kokai) No.62-23903 discloses production method characterized by hydrogen heat treatment at an elevated temperature, for example at 800° C., which produces a RFeB type permanent magnet powder having intrinsic coercivity (iHc) of 398 kA/m. The hydrogen heat treatment comprises hydrogenation accompanied by phase transformation from $R_2Fe_{14}B$ phase to $RH_2+\alpha Fe+Fe_2B$ and desorption accompanied by reverse transformation from $RH_2+\alpha Fe+Fe_2B$ to $R_2Fe_{14}B$ phase. In No.62-23903, crushing step is performed between the hydrogenation step and desorption step. It had been known before Japanese Patent Application Laid-open (Kokai) No.62-23903 that phase transformation takes place in hydrogen heat treatment at an elevated temperature of 800° C.

No.62-23903 is the first patent application that disclosed that the phase transformation during hydrogen heat treatment gives improved magnetic properties for RFeB type magnet alloy.

Japanese Examined Patent Publication (Kokoku) No.7-68561 discloses a production method, similar to No.62-23903 above mentioned, which produces a RFeB type permanent magnet powder having intrinsic coercivity (iHc) of 795 kA/m by omitting the crushing step to perform hydrogenation and desorption successively. In the improved hydrogen heat treatment the disproportionation reaction between RFeB type alloy and hydrogen is introduced at a temperature from 500° C. to 1000° C. at the hydrogen pressure of more than 1.3 kPa, and subsequent desorption reaction is introduced at the same temperature at the hydrogen pressure of less than 0.1 Torr.

No.7-68561 discloses the hydrogen heat treatment method also can introduce small degree of anisotropy in the magnet powder with the composition of $Nd_{12.0}Pr_{1.4}Fe_{80.8}B_{5.8}$. The powder is heated to 830° C. in hydrogen atmosphere at a pressure of 1 atm, held at the said temperature and pressure of 1.3 kPa–0.1 MPa for 5 hours, then held at the temperature of 830° C. at reduced pressure of $1.31\times10^{-3}$ Pa for 40 minutes, followed by quenching. The residual induction (Br) of the bonded magnet is improved from 0.61T to 0.72T, which means improvement of 18.2%, by applying magnetic field during compression-molding.

Japanese Examined Patent Publication (Kokoku) No.4-20242 discloses a production method for rare earth permanent magnet having high degree of anisotropy by aligning the crystal orientation of microstructure in the rare earth magnet by hot deformation of melt-spun rare earth material.

The Problem to be Solved by the Invention

It is the object of the invention to provide a rare earth magnet powder having excellent anisotropy, that means Br/Bs of more than 0.65, by hydrogen heat treatment.

Thus far, two major methods, hot deformation process and hydrogen heat treatment, are proposed to introduce anisotropy in the magnet powder.

The hot deformation process that introduces alignment of the crystal orientation of microstructure in the rare earth magnet has a drawback of increased production cost because of its complicated process. In addition to said drawback, the grain of the powder is plate-like which is unfavorable for the production of bonded magnet.

On the other hand, hydrogen heat treatment is known to improve magnetic properties such as magnetic remanence and coercivity. In the hydrogen heat treatment, the grain size is refined by the phase transformations introduced during the hydrogenation process and the hydrogen desorption process and thus enhances magnetic properties. This hydrogen heat treatment has a merit of low production cost due to relatively simple operation, however, the obtained magnetic properties are not satisfactory. It is also quite difficult to obtain anisotropic magnet powder by this treatment.

As is mentioned previously, in Japanese Examined Patent Publication No.7-68561, it is reported that the Br of the $Nd_{12.0}Pr_{1.4}Fe_{80.8}B_{5.8}$ rare earth magnet is improved from 0.61T to 0.72T, which means improvement of 18.2%, by applying magnetic field during compression-molding.

One of the inventors of the patent application insists in his review in J. Alloys and Compounds 231 (1995) 51 that the substitution of Fe with Co in the ternary Nd—Fe—B alloy and additions of elements such as Zr, Ga, Hf, Nb are essential to obtain high degree of anisotropy, but the ternary Nd—Fe—B alloy without substitution of Co only gives isotropic magnet even though it is hydrogen-heat treated.

By an intensive study for hydrogen heat treatment of RFeB magnet, we have discovered that the ternary NdFeB alloy without any substitution nor addition of elements, considered to be isotropic thus far, can have high degree of anisotropy by hydrogen heat treatment. In other words we have discovered that the residual induction (Br) is improved from 0.8T to 1.2–1.5T in NdFeB ternary alloy without Co substitution by the hydrogen heat treatment.

We consider that anisotropy of the magnet is induced in following way. First, the crystal orientation of $Nd_2Fe_{14}B$ is transferred to the crystal orientation of nanocrystalline $Fe_2B$ that is generated by the phase transformation during the hydrogenaration of NdFeB alloy in hydrogen heat treatment. Then, the crystal orientation of nanocrystalline $Fe_2B$ is transferred to the crystal orientation of nanocrystalline $Nd_2Fe_{14}B$ that is regenerated by the reverse transformation during hydrogen desorption in hydrogen heat treatment. As a result the original orientation of mother crystal can be kept in the nanocrystalline $Nd_2Fe_{14}B$ after phase transformations, that is, the obtained magnet powder shows very high degree of anisotropy.

The present invention is completed from the viewpoint described above.

Means of Solving the Problem

The rare earth magnet powder offered by present invention consists essentially of rare earth element including yttrium (hereinafter denoted by R), iron (Fe), and boron (B) and have excellent anisotropy, that means Br/Bs of more than 0.65, given by hydrogen heat treatment accompanied with phase transformation.

Here, the inventors define anisotropy as Br/Bs (here Bs equals to 1.6T(16 kG)) of more than 0.65, perfect anisotropy as Br/Bs of unity, isotropy as Br/Bs of over 0.5 to 0.65, and perfect isotropy as Br/Bs of 0.5, respectively. It is very hard to obtain perfect isotropy or perfect anisotropy because RFeB crystal is anisotropic by nature, on the other hand the particle in the powder is apt to be isotropic. The high degree of anisotropy in RFeB based alloy by the present invention is due to good alignment of recrystallized grains of $R_2Fe_{14}B$ of which tetragonal structure, as is well known, shows strong crystal magnetic anisotropy.

Br of the specimen is measured by VSM (vibrating sample magnetometer) because ordinary BH curve tracer can not measure Br of the powder materials.

The specimens are prepared in following method. The magnet powder is classified into 74–105 $\mu$m size. The powder is formed into a specimen having demagnetizing factor of 0.2, and then the magnetization direction of each particle is aligned in a magnetic field of 4578 kA/m (45 kOe).

The rare earth magnet powder offered by present invention is also characterized by its spherical grain shape from the anisotropic powders obtained by the hot deformation process. The grains of the powder according to the present invention are spherical with the aspect ratio of less than 2.0. Its diameter is 0.1–1.0 $\mu$m.

Here, the word "grain" does not mean each magnet powder particle, but means each crystal grain. One particle of the powder consists of many crystal grains. The aspect ratio is defined as the ratio of the greatest dimension to the smallest dimension (greatest dimension/smallest dimension) of the grain.

The grains of rare earth magnet by hot deformation is plate-like shape, which is entirely different from the ones obtained by hydrogen heat treatment mentioned above.

The RFeB based alloy for the present invented anisotropic magnet powder is composed of 12–15at % R, 5.5–8 at % B and the balance of Fe with unavoidable impurity.

R of more than 15 at % causes decrease in Br due to decrease in magnetic moment of the crystal, conversely, R of less than 12 at % causes decrease in iHc due to increased $\alpha$Fe amount in primary crystal.

B of more than 8 at % causes decrease in Br due to decrease in magnetic moment of the crystal, conversely, B of less than 5.5 at % causes decrease in iHc due to precipitation of $R_2Fe_{17}$.

R can be one or more rare earth elements chosen from the group of Y, La, Ce, Pr, Nd, Sm, Gd, Tb, Dy, Ho, Er, Tm, Lu. It is desirable to choose Nd due to its low cost and potential of offering superior magnetic properties for its alloys.

Addition of 0.01–1.0 at % of Ga enhances intrinsic coercivity of RFeB. The reason is considered that Ga may smooth out the grain boundary and suppress the nucleation of the reversed magnetic domains. Addition of 0.01–0.6 at % of Nb together with the hydrogen heat treatment offered in the present invention enhances the degree of anisotropy, however, the enhancement by Nb addition is obtained only in the case that magnet powder is treated by present invented hydrogen heat treatment. In other words, the enhancement is the interaction with Nb addition and proper condition of hydrogen heat treatment. The reason of enhancement is considered that Nb may help to transfer the crystal orientation of $Nd_2Fe_{14}B$ to that of $Fe_2B$.

The raw material of the present invented anisotropic magnet powder is prepared by melting prescribed amount of purified rare earth, iron, and boron in a furnace, and then cast into an ingot. The ingot can be crushed into powder and used as raw material.

It is desirable that the raw materials are homogenized, since homogenizing treatment decreases segregation that is unfavorable for the magnetic properties.

The raw material prepared in the foregoing manner is subjected to the hydrogen heat treatment described below to have the degree of anisotropy (Br/Bs, here Bs equals to 1.6T(16 kG)) of more than 0.65, Br of 1.2 to 1.5T, iHc of 636 to 1272 kA/m, and maximum energy product ((BH)max) of 238 to 358 kJ/m$^3$.

The hydrogen heat treatment of the present invention is characterized by controlling the reaction between the alloy and hydrogen at the relative reaction rate of 0.25–0.50 in which phase transformation is introduced during hydrogenation and reverse transformation during hydrogen desorption in RFeB.

The inventors have found that the rate of phase transformation has great effect on the magnetic anisotropy of RFeB based alloys.

The rate of phase transformation is proportional to the rate of reaction between the hydrogen and RFeB based alloys.

The rate of reaction V is defined as;

$$V=V_o\times(PH_2/P_0)^{1/2}\times\exp(-E_a/RT)$$

here, $V_o$ is frequency factor, $PH_2$ is hydrogen pressure, $P_0$ is dissociation pressure, Ea is activation energy of the alloy, R is gas constant, T is absolute temperature of the system.

The relative reaction rate $V_r$ is defined as the ratio of reaction rate V to the standard reaction rate $V_b$, which is defined as the reaction rate for the temperature of 830° C. and hydrogen pressure of 0.1 MPa in the case of phase transformation of $R_2Fe_{14}B$ phase to $RH_2+\alpha Fe+Fe_2B$. Therefore $V_r=V/V_b=(1/0.576)\times(PH_2)^{1/2}\times\exp(-Ea/RT)$ for the phase transformation.

As for the reverse transformation, $V_b$ (reverse) is the reaction rate for the temperature of 830° C. and hydrogen pressure of 0.001 MPa.

$V_r$ (reverse) for the reverse transformation can be obtained similar manner.

As shown in FIG. 1, activation energy (Ea) depends on the composition and varies from 195 to 200 kJ/mol.

The activation energy Ea for each composition is calculated value using the value of the formation heat of $NH_2$ from Nd and Hydrogen.

The relationship between reaction temperature and relative reaction rate at Ea=195 kJ/mol, the value of which is for stoichiometric $Nd_2Fe_{14}B$, is shown in FIG. 2. In the figure the square area shows the temperature range for desirable relative reaction rate, the range of 0.25–0.5. Similarly, the relationship between hydrogen pressure and relative reaction rate at same Ea is shown in FIG. 3. In the figure the square area shows the hydrogen pressure range for desirable relative reaction rate. In order to obtain the relative reaction rate of phase transformation within the range of 0.25–0.50, reaction temperature and hydrogen pressure have to be set within 780–840° C., 0.01–0.06 MPa, respectively.

When the relative reaction rate of phase transformation in RFeB is controlled within the range of 0.25–0.50, anisotropic magnet powders of more than 0.65 in Br/Bs are obtained. As mentioned before, we consider that anisotropy of the magnet is induced by transfer of the crystal orientation of $Nd_2Fe_{14}B$ to the crystal orientation of nanocrystalline $Fe_2B$. As a result the magnet shows very high degree of anisotropy, that is, Br/Bs of more than 0.65.

When the relative reaction rate is greater than 0.50 only isotropic magnet powder is obtained. It is because that the phase transformation takes place too rapid to transfer the crystal orientation of $Nd_2Fe_{14}B$ to the $Fe_2B$ crystal in order. Thus the degree of anisotropy decreases to Br/Bs of less than 0.65.

It is found out that good transfer of crystal orientation in the phase transformation assures anisotropy of $Nd_2Fe_{14}B$ crystal after the hydrogen desorption step. In other words, sufficient transfer of crystal orientation is essential for the magnet to have high degree of anisotropy.

On the other hand, when the relative reaction rate is smaller than 0.25, the high coercivity (iHc) is not obtained. (BH)max is not high although Br is relatively high. It is because that the phase transformation from $Nd_2Fe_{14}B$ phase to $RH_2+\alpha Fe+Fe_2B$ is not finished and the residual $Nd_2Fe_{14}B$ makes microstructure after reverse transformation inhomogeneous.

In the foregoing the word "reaction temperature" indicates the actual temperature at which phase transformation in RFeB takes place by absorption of hydrogen. It should be noted that the reaction temperature is different from the control temperature of the furnace.

The temperature of the RFeB alloy in the reaction may be much higher than that of the furnace because the heat generated by the reaction, which is exothermic, may raise its temperature.

Similarly the hydrogen pressure may vary from the set pressure, because the pressure of hydrogen in neighborhood of alloy is apt to decrease by depletion due to occlusion of hydrogen in RFeB. Especially in the case when the atmosphere is mixture of inert gas and hydrogen, partial pressure of hydrogen in neighborhood of alloy may significantly decrease by depletion due to occlusion of hydrogen in RFeB while total pressure is kept at near the set pressure.

The above phenomena concerning the reaction between hydrogen and RFeB results difficulty in controlling the temperature and pressure for the conventional furnaces to obtain the relative rate of reaction within the range of 0.25–0.50 for following reasons. One is that the deviations in temperature and pressure are proportional to the mass of the material in the furnace. The other is that the reaction is self-exciting, i.e., it is accelerated by the heat generated in the exothermic reaction itself. Therefore, to obtain desired conditions for the reaction, specially designed furnace is needed to have proper control of temperature and hydrogen pressure.

To solve the above mentioned problem, we have developed and employed a novel furnace that can cancel the heat generated by the reaction. The furnace is disclosed in the Japanese Patent Application Laid-open (kokai) No.8-206231.

The furnace has heat absorbent means to cancel the heat generated by the reaction with hydrogen in the raw material. The furnace has a set of a processing vessel and a heat compensating vessel in contact. Raw material is inserted in the processing vessel in which the hydrogen pressure as well as the temperature can be controlled. Dummy material is inserted in the compensating vessel also in which the hydrogen pressure as well as the temperature can be controlled independently with the processing vessel. When exothermic reaction occurs and the material generates heat in the processing vessel, in addition to turning off the heater, the hydrogen pressure of the compensating vessel is decreased to start endothermic reaction and to compensate for the generated heat in the processing vessel. Thus the reaction temperature can be kept to nearly equal to the set temperature of the furnace.

As a result the desired conditions for the phase transformation can be obtained in mass production by this novel furnace.

After the completion of hydrogenation step, it is desirable to subject the powder in stress relief treatment, that is, to keep the magnet powder at same temperature. It is found out that intrinsic coercivity of the powder is enhanced by keeping the powder for at least an hour. The completion of hydrogenation requires about 30 minutes, however actually it depends on treatment volume.

The reason is considered that the enhancement in coercivity may be due to the relaxation of the internal strain induced by the phase transformation.

If the internal strain remains in magnet powder, microstructure after hydrogen desorption may be apt to inhomogeneous, and the intrinsic coercivity is deteriorate as a result.

After the stress relief treatment in hydrogen, the powder is subjected to hydrogen desorption step in which the reverse transformation takes place.

During this reverse transformation the crystalline orientation of nanocrystalline $Fe_2B$ is transferred to the orientation of nanocrystalline $Nd_2Fe_{14}B$.

It is desirable to control the the relative reaction rate of reverse transformation within the range of 0.1–0.4 to transfer the crystal orientation of nanocrystalline $Fe_2B$ in a low hydrogen pressure at the same temperature to hydrogenation step.

When the relative reaction rate of reverse transformation is controlled within the range of 0.1–0.4, the degree of anisotropy is enhanced by transferring of the crystal orientation of nanocrystalline $Fe_2B$ to the crystal orientation of nanocrystalline $Nd_2Fe_{14}B$ in good order.

For the relative reaction rate of reverse transformation smaller than the above range, the high coercivity is not obtained owing to inhomogeneous microstructure due to imbalance in nucleation and growth. On the other hand, for the relative reaction rate greater than the above range, the degree of anisotropy in the magnet powder is deteriorated because the transfer of the crystal orientation of nanocrystalline $Fe_2B$ to that of recrystallized $Nd_2Fe_{14}B$ is disturbed.

In the actual operation the hydrogen pressure is set $1/10$–$1/100$ of the pressure in the hydrogenation step.

However the reverse transformation, which is endothermic, is also self-exciting, therefore the temperature of the raw material significantly decrease.

In order to set the reaction temperature within 780–840° C., it is necessary to use the same furnace for the hydrogenation process.

The time needed to complete the reaction of the reverse transformation is supposed to be about 10 minutes, however actually it depends on treatment volume.

After the completion of reverse transformation, hydrogen which comes by $NdH_2$ decomposition remains in the $Nd_2Fe_{14}B$ crystal lattice. Hydrogen elimination treatment is carried out in which the powder is kept at same temperature for a certain time. The treatment is to perfectly eliminate the remaining hydrogen in the $Nd_2Fe_{14}B$ crystal lattice. It is found out that intrinsic coercivity is enhanced by at least 25 minutes of hydrogen elimination treatment. It is considered that remaining hydrogen in the lattice deteriorates intrinsic coercivity of $Nd_2Fe_{14}B$ powder.

After the hydrogen elimination treatment the powder in the furnace is cooled to the room temperature. Cooling should be done as rapid as possible, at least 5° C./min is needed. Only by following forgoing steps the anisotropic magnet powder with Br/Bs of more than 0.65 is obtained.

The obtained powder is formed into bonded magnet by following conventional process.

As the raw material ingot or powder is used. The processed material will be small lumps. They can be pulverized easily into anisotropic magnet powder by the mortar or crushing machine.

The anisotropic bonded magnet is produced from compound of anisotropic magnet powder and binder. As the binder resin, low melting point metals, rubber and so on are available. When thermosetting resin such as epoxy resin is selected as binder, compression molding is employed. First the magnet powder and the thermosetting resin are mixed into compounds. Then compression molding was carried out with applied magnetic field, then the magnet is cured by heat treatment.

The present invented anisotropic magnet powder has very high degree of anisotropy, evaluated by Br/Bs, of more than 0.65. It has a superior magnetic properties, that is, Br of over 1.2T (12 kG) and iHc of over 636 kA/m (8 kOe). The anisotropic bonded magnet made from the powder has excellent (BH)max of more than 135 kJ/$m^3$.

Above superior magnetic properties are obtained only by the present invented process in which the relative reaction rate of the phase transformation in hydrogen heat treatment is controlled within fixed rate of 0.25–0.50. The process is applicable to mass production of rare earth magnet having the excellent anisotropy mentioned above by employing the novel furnace developed by us.

Embodiment according to the present invention will be described hereafter.

The present invented anisotropic magnet powder has very high degree of anisotropy, that is, Br/Bs of more than 0.65, here Bs equals to 1.6T(16 kG).

The anisotropic bonded magnet made from the anisotropic magnet powder has excellent (BH)max.

The present invented anisotropic magnet powder can be produced by choosing proper range of phase transformation rate of hydrogenation.

EMBODIMENT 1

Figure 1:
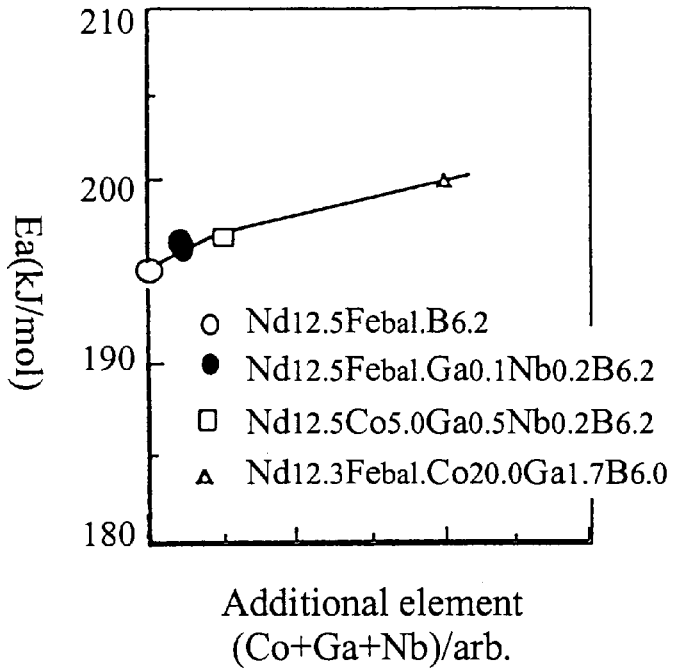
FIG. 1 is a graph showing the relationship between the concentration of additional elements Co, Ga and Nb in alloy and activation energy.
Figure 2:
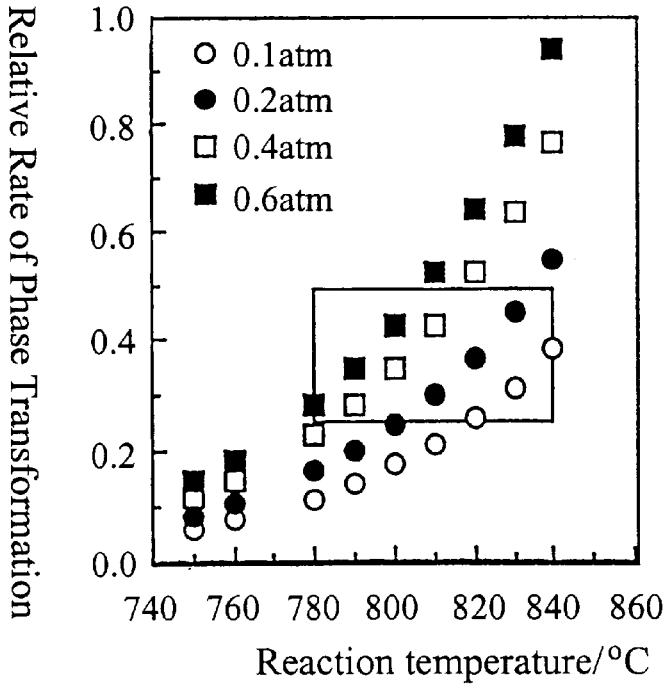
FIG. 2 is a graph showing the relationship between the reaction rate and the reaction temperature at set hydrogen pressure.
Figure 3:
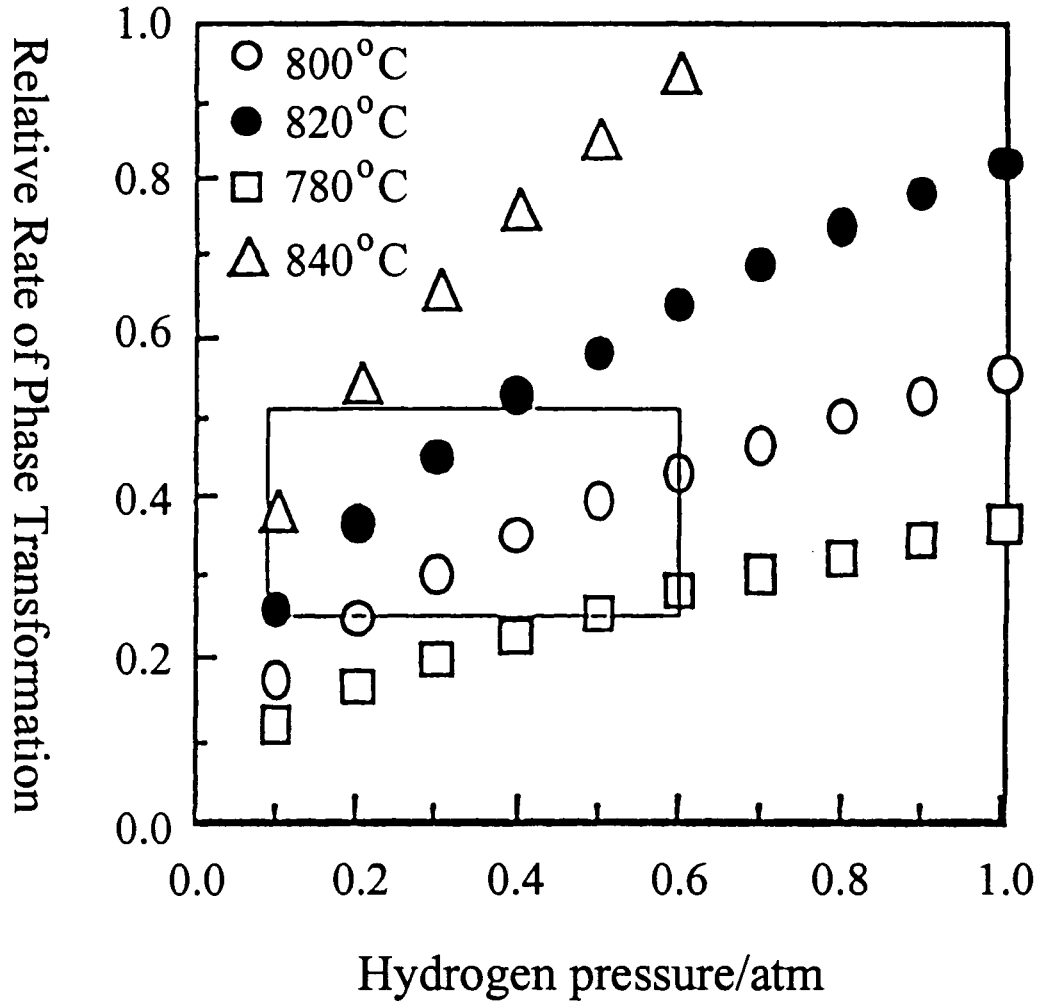
FIG. 3 is a graph showing the relationship between the reaction rate and the hydrogen pressure at set reaction temperature.

Nd—Fe—B type alloy with a chemical composition of Nd12.5, B6.2 at % and balanced with Fe is melted by arc melting and cast into an alloy ingot. The alloy ingot was homogenized at 1140° C., then was subjected to a hydrogen heat treatment in the condition shown in table 1.

Detailed conditions for the hydrogen heat treatment are as follows.

15 g of raw material is placed in a processing vessel which is connected to the hydrogen pressure control equipment. An infrared mirror furnace was used to heat the material.

The material temperature and the processing vessel temperature were measured by thermocouples. The furnace temperature was controlled according to the material temperature and the processing vessel temperature. Hydrogen gas of the pressure shown in table 1 was introduced into the processing vessel. The temperature was elevated in 60 minutes from room temperature to the reaction temperature shown in the table 1. The raw material temperature was maintained within +5° C.–0° C. by the following control method.

When the raw material temperature exceed the processing vessel temperature during the reaction, immediately the furnace is turned off, and the material is cooled to the processing vessel temperature. Thus the heat generated by the reaction is removed. The constant temperature of within +5° C.–0° C. is attained by this simple control, due to the small amount of material and good controllability of infrared mirror furnace.

Then the material was subjected to a stress relief heat treatment at 820° C. in the hydrogen pressure of 0.02 MPa for 3 hours. Then the hydrogen in the processing vessel was evacuated at the relative reaction rate of 0.26 to let the revere transformation take place.

In order to control the raw material temperature within +0° C. −5° C. during the reverse transformation induced by hydrogen desorption, following control is applied. When the raw material temperature shifts lower from the processing vessel temperature by endothermic reaction, the hydrogen pressure control equipment turns off the hydrogen evacuation, and after the raw material temperature recovers to the processing vessel temperature, hydrogen evacuation is started again.

The hydrogen is evacuated until it reaches a pressure of 0.0001 MPa, which is less than 1/100 of the hydrogen pressure in the phase transformation.

After the completion of reverse transformation, the material was subjected to a hydrogen elimination treatment at set temperature for 30 minutes and cooled.

Thus the whole process of hydrogen heat treatment is finished and anisotropic magnet powder is obtained.

The residual induction of the obtained anisotropic magnet powder is measured and the degree of anisotropy is calculated. The residual induction (Br), the degree of anisotropy, relative rate of phase transformation, treatment temperature, and hydrogen pressure of phase transformation are shown in table 1.

The aspect ratio is determined by the average of the greatest dimension and the smallest dimension measured with the electron microscope for 25 samples of grain.

When the relative reaction rate of phase transformation is controlled within the range of 0.25–0.50, the high degree of anisotropy is obtained.

As mentioned before, it may be due to transfer of the crystal orientation of $Nd_2Fe_{14}B$ to the crystal orientation of nanocrystalline $Fe_2B$.

For the relative reaction rate greater than the above range, however, only isotropic magnet powder is obtained because the transfer of the crystal orientation of $Nd_2Fe_{14}B$ to the $Fe_2B$ crystal is insufficient.

On the other hand, for the relative reaction rate smaller than the above range, the high coercivity (iHc) is not obtained. High (BH)max is not obtained although the Br is relatively high. It is because of inhomogeneous microstructure due to the residual $Nd_2Fe_{14}B$.

EMBODIMENT 2

The conditions of hydrogen heat treatment in embodiment 2 is the same as in sample No.1 of the embodiment 1 except for the condition of the stress relief treatment after hydrogenation.

Holding temperature, holding hydrogen pressure and holding time is shown in table 2. (As for the comparative sample No.54, the conditions of stress relief treatment is the same as that of sample No.52 of the embodiment 1)

The treatments after the stress relief treatment is just the same as that of embodiment 1, that is, the hydrogen in the processing vessel was evacuated at a relative reaction rate of 0.26 to let the revere transformation take place and the material was subjected to hydrogen elimination treatment at 820° C. in the vacuum for 30 minutes and then is cooled.

The magnetic properties of the obtained magnet powder are shown in table 2.

The residual induction, intrinsic coercivity, (BH)max of the rare earth magnet powder is measured and the degree of anisotropy is calculated.

The relative rate of the phase transformation, holding time, holding temperature, holding hydrogen pressure, the residual induction, the degree of anisotropy, coercivity, and (BH)max are shown in table 2.

The procedure of the stress relief treatment in the embodiment 2 is as follows.

First the phase transformation was introduced in the material in a same manner as embodiment 1 at the set of reaction temperatures.

Then the material was held at the same temperature under set holding pressure for set holding time to relax the strain induced by phase transformation in the material. Subsequently hydrogen desorption was carried out by evacuating the hydrogen to vacuum of 0.0001 MPa (0.001 atm).

As a result high degree of anisotropy comparable to those of the samples in embodiment 1 was obtained except for the comparative sample No.54.

As shown in table 2 a holding time more than 60 minutes gives higher coercivity and (BH)max than those of embodiment 1.

On the other hand, for the holding time less than 60 minutes, the coercivity decreases because the stress makes microstructure after reverse transformation inhomogeneous. As shown in table 2, degree of anisotropy is independent to holding time. The degree of anisotropy is maintained to a high level as long as reaction rate is chosen proper.

In the case the reaction rate is fast as in the case of comparative sample No.54, the anisotropy is lost and can not be recovered after the stress relief treatment and hydrogen desorption.

EMBODIMENT 3

The conditions of hydrogen heat treatment in embodiment 3 is the same as that of sample No.7 of the embodiment 2 except for the condition for reverse transformation.

Table 3 shows the reverse transformation temperature, relative rate of reverse transformation and the hydrogen pressure of the reverse transformation of 0.0001 MPa (0.001 atm) at which the reverse transformation was introduced in the material.

Then the hydrogen elimination treatment was carried out in vacuum at 820° C. and 30 minutes and finally the material was cooled to room temperature. (As for the comparative sample No.56, the conditions of hydrogen heat treatment is the same as in the comparative sample No.52 of the embodiment 1)

The residual induction, intrinsic coercivity, (BH)max of the anisotropic magnet powder is measured and the degree of anisotropy is calculated. They are also shown in table 3.

When the relative reaction rate of reverse transformation is controlled within the range of 0.1–0.4, the degree of anisotropy is enhanced by transferring of the crystal orientation of nanocrystalline $Fe_2B$ to the crystal orientation of nanocrystalline $Nd_2Fe_{14}B$ in good order.

For the relative reaction rate of reverse transformation smaller than the above range, as is in the case of comparative sample No.55, the high coercivity (iHc) is not obtained owing to inhomogeneous microstructure due to imbalance in nucleation and growth. On the other hand in the case the reaction rate is fast as in the case of comparative sample No.56, the anisotropy is lost and can not be recovered after the hydrogen desorption carried out in a proper conditions.

EMBODIMENT 4

The conditions of hydrogen heat treatment in embodiment 4 is the same as that of sample No.11 of the embodiment 3 except for the condition of hydrogen eliminating treatment in vacuum. Holding temperatures and holding times for the hydrogen eliminating treatment in vacuum are shown in table 4. (As for the comparative sample No.56, the conditions of hydrogen elimination treatment is the same as that of comparative sample No.54 of the embodiment 2).

100 g of obtained magnets powder and 3 g of phenol formaldehyde resin as the binder were mixed and formed into bonded magnet by compression molding with or without applied magnetic field of 2T(20 kOe).

The residual induction, intrinsic coercivity, (BH)max of the rare earth magnet powder, the residual hydrogen concentration in the magnet powder in weight % and (BH)max of the bonded magnet are measured and the degree of anisotropy is calculated.

The relative reaction rate of the phase transformation, holding time, the relative reaction rate of the reverse transformation, holding temperature and holding time for the hydrogen elimination treatment in vacuum are shown in table 4. The magnetic properties for the powders and bonded magnets are shown in table 5.

As seen in table 4 a holding time of more than 25 minutes gives high coercivity while keeping high degree of anisotropy because the hydrogen is eliminated completely from the material.

On the other hand, for the shorter holding time, as in the case of comparative sample No.55, the high coercivity can not be obtained due to the residual hydrogen.

When the reaction rate of phase transformation is great as in the case of comparative sample No.56, the anisotropy is lost and can not be recovered after the hydrogen elimination treatment carried out in a proper conditions.

EMBODIMENT 5

Nd—Fe—B type alloys with a chemical composition of Nd12.5, B6.2 at % and balanced with Fe are melted with small addition of Ga and Nb, as shown in table 6, by arc melting and cast into an alloy ingot for the same condition as in the embodiment 1.

The alloy ingot was homogenized at 1140° C., then was subjected to a hydrogen heat treatment in the condition shown in table 6.

The magnetic properties of the powder are measured by the method described in the embodiment 4. The results are shown in table 7.

Magnet powder is improved to have a (BH)max of as high as 350 kJ/$m^3$ by the small addition of Ga and Nb in NdFeB alloys.

The reason of improvement by Ga and Nb addition is unknown, however, we think that addition of Ga may smooth the grain boundaries and suppresses the nucleation of reverse domain. As a result the high coercivity is obtained.

The addition of Nb may enhance the transfer effect of crystal orientation of $Nd_2Fe_{14}B$ to the crystal orientation of nanocrystalline $Fe_2B$.

TABLE 1

| No. | Relative reaction rate of phase transformation | Reaction temperature for phase transformation (° C.) | Hydrogen pressure for phase transformation (MPa) | Anisotropy(Bs1.6Tesla) B/Tesla | Degree of anisotropy | average aspect ratio |
|---|---|---|---|---|---|---|
| 1 | 0.35 | 820 | 0.02 | 1.20 | 0.75 | 1.8 |
| 2 | 0.30 | 800 | 0.02 | 1.22 | 0.76 | 1.6 |
| 3 | 0.45 | 830 | 0.02 | 1.21 | 0.75 | 1.7 |
| 4 | 0.28 | 780 | 0.05 | 1.20 | 0.75 | 1.8 |
| 5 | 0.44 | 835 | 0.02 | 1.20 | 0.75 | 1.5 |
| 51 | 0.175 | 700 | 0.01 | 1.10 | 0.69 | 1.6 |
| 52 | 1.0 | 830 | 0.1 | 0.76 | 0.47 | 1.7 |

TABLE 2

| No. | Relative reaction rate of phase transformation | Holding temperature for stress relief treatment (° C.) | Hydrogen pressure for stress relief treatment (MPa) | Holding time for stress relief treatment (minutes) | Anisotropy(Bs1.6Tesla) B/Tesla | Degree of anisotropy | $_iH_c$ (kA/m) | $(BH)_{max}$ (kJ/m$^3$) |
|---|---|---|---|---|---|---|---|---|
| 6 | 0.35 | 820 | 0.02 | 60 | 1.21 | 0.76 | 358 | 188 |
| 7 | 0.35 | 820 | 0.02 | 180 | 1.20 | 0.75 | 716 | 242 |
| 8 | 0.35 | 800 | 0.01 | 180 | 1.22 | 0.76 | 398 | 199 |
| 9 | 0.35 | 900 | 0.02 | 180 | 1.23 | 0.77 | 406 | 196 |
| 10 | 0.35 | 700 | 0.03 | 240 | 1.21 | 0.76 | 382 | 198 |
| 53 | 0.35 | 820 | 0.02 | 30 | 1.20 | 0.75 | 191 | 156 |
| 54 | 1.0 | 830 | 0.02 | 180 | 0.78 | 0.49 | 446 | 1030 |

TABLE 3

| No. | Relative reaction rate of phase transformation | Holding time for for stress relief treatment (minutes) | Relative reaction rate of reverse transformation | Hydrogen pressure for reverse transformation (MPa) | Reaction temperature for reverse phase transformation (° C.) | Anisotropy (Bs1.6Tesla) B/Tesla | Degree of anisotropy | $_iH_c$ (kA/m) | $(BH)_{max}$ (kJ/m$^3$) |
|---|---|---|---|---|---|---|---|---|---|
| 11 | 0.35 | 180 | 0.26 | 0.0001 | 820 | 1.21 | 0.76 | 716 | 242 |
| 12 | 0.35 | 180 | 0.21 | 0.0001 | 810 | 1.22 | 0.76 | 366 | 198 |
| 13 | 0.35 | 180 | 0.30 | 0.0001 | 835 | 1.23 | 0.77 | 406 | 199 |
| 14 | 0.35 | 180 | 0.14 | 0.0001 | 792 | 1.22 | 0.76 | 390 | 199 |
| 15 | 0.35 | 180 | 0.38 | 0.0001 | 840 | 1.21 | 0.76 | 422 | 202 |
| 55 | 0.35 | 180 | 0.075 | 0.0001 | 760 | 1.15 | 0.72 | 239 | 143 |
| 56 | 1.0 | 180 | 1.0 | 0.0001 | 830 | 0.80 | 0.50 | 469 | 108 |

TABLE 4

| No. | Relative reaction rate of phase transformation | Holding time for stress relief treatment (minutes) | Relative reaction rate of reverse transformation | Holding temperature for hydrogen eliminating treatment (° C.) | Holding time for hydrogen eliminating treatment (minutes) |
|---|---|---|---|---|---|
| 16 | 0.35 | 180 | 0.26 | 820 | 30 |
| 17 | 0.35 | 180 | 0.26 | 820 | 60 |
| 18 | 0.35 | 180 | 0.26 | 820 | 120 |
| 19 | 0.35 | 180 | 0.26 | 700 | 120 |
| 20 | 0.35 | 180 | 0.26 | 900 | 120 |
| 55 | 0.35 | 180 | 0.26 | 820 | 10 |
| 56 | 1.0 | 180 | 0.26 | 820 | 30 |

TABLE 5

| No. | Anisotropy(Bs1.6Tesla) B/Tesla | Degree of anisotropy | $_iH_c$ (kA/m) | $(BH)_{max}$ (kJ/m$^3$) | Residual hydrogen (wt %) | $(BH)_{max}$ of bonded magnet (kJ/m$^3$) without field | with field |
|---|---|---|---|---|---|---|---|
| 16 | 1.20 | 0.75 | 716 | 242 | 0.003 | 65.2 | 135.2 |
| 17 | 1.22 | 0.76 | 732 | 239 | 0.003 | 64.4 | 136.0 |
| 18 | 1.23 | 0.77 | 724 | 239 | 0.002 | 63.6 | 135.2 |
| 19 | 1.22 | 0.76 | 618 | 235 | 0.001 | 63.6 | 136.0 |
| 20 | 1.22 | 0.76 | 652 | 228 | 0.003 | 62.8 | 135.2 |

TABLE 5-continued

| No. | Anisotropy(Bs1.6Tesla) B/Tesla | Degree of anisotropy | $_iH_c$ (kA/m) | $(BH)_{max}$ (kJ/m$^3$) | Residual hydrogen (wt %) | $(BH)_{max}$ of bonded magnet (kJ/m$^3$) without field | with field |
|---|---|---|---|---|---|---|---|
| 55 | 1.23 | 0.76 | 422 | 192 | 0.011 | 63.6 | 105.8 |
| 56 | 0.79 | 0.49 | 732 | 122 | 0.003 | 64.4 | 66.0 |

TABLE 6

| No. | Chemical compositions Ga/at % | Nb/at % | Relative reaction rate of phase transformation | Reaction temperature for phase transformation (° C.) | Hydrogen pressure for phase transformation (MPa) | Relative reaction rate of reverse transformation | Reaction temperature for reverse phase transformation (° C.) | Hydrogen pressure for reverse transformation (MPa) |
|---|---|---|---|---|---|---|---|---|
| 21 | 0.1 | 0.2 | 0.36 | 820 | 0.03 | 0.26 | 820 | 0.0001 |
| 22 | 0.3 | 0.1 | 0.36 | 820 | 0.03 | 0.26 | 820 | 0.0001 |
| 23 | 0.5 | 0.2 | 0.28 | 800 | 0.04 | 0.26 | 800 | 0.0001 |
| 24 | 0.5 | 0.4 | 0.31 | 800 | 0.05 | 0.26 | 800 | 0.0001 |
| 25 | 0.05 | 0.2 | 0.29 | 820 | 0.02 | 0.26 | 820 | 0.0001 |
| 57 | 1.5 | 0.2 | 0.37 | 820 | 0.06 | 0.26 | 820 | 0.0001 |
| 58 | 0.1 | 1.0 | 0.45 | 830 | 0.06 | 0.26 | 830 | 0.0001 |

TABLE 7

| No. | Anisotropy(Bs1.6Tesla) B/Tesla | Degree of anisotropy | $_iH_c$ (kA/m) | $(BH)_{max}$ (kJ/m$^3$) | $(BH)_{max}$ of bonded magnet (kJ/m$^3$) without field | with field |
|---|---|---|---|---|---|---|
| 21 | 1.39 | 0.86 | 955 | 350 | 83.5 | 200.5 |
| 22 | 1.36 | 0.85 | 1130 | 318 | 74.8 | 178.2 |
| 23 | 1.37 | 0.86 | 1193 | 312 | 74.8 | 174.2 |
| 24 | 1.32 | 0.82 | 1145 | 300 | 70.8 | 167.9 |
| 25 | 1.37 | 0.86 | 796 | 321 | 71.6 | 179.8 |
| 57 | 1.19 | 0.74 | 716 | 242 | 65.2 | 135.2 |
| 58 | 1.14 | 0.71 | 366 | 226 | 58.9 | 126.5 |

What is claimed is:

1. Method of producing anisotropic magnet powders composed of rare earth element including yttrium (R), iron (Fe), and boron (B), said method comprising a hydrogenation step carried out at 780–840° C. and a hydrogen pressure of 0.01–0.06 MPa, and in which the relative rate of reaction between a R—Fe—B based alloy and hydrogen is controlled within the range of 0.25–0.50 to introduce phase transformation in said R—Fe—B based alloy and a subsequent hydrogen desorption step to introduce reverse transformation in said R—Fe—B based alloy.

2. Method of producing anisotropic magnet powders as set forth in claim 1, wherein said phase transformation is introduced under constant temperature by cancelling the heat generated by exothermic reaction.

3. Method of producing anisotropic magnet powders as set forth in claim 1, wherein said R—Fe—B based alloy is kept in hydrogen after completion of phase transformation at the same temperature for at least one hour to relieve the stress induced by the phase transformation.

4. Method of producing anisotropic magnet powders as set forth in claim 1, wherein the relative reaction rate of reverse transformation is controlled within the range of 0.1–0.4.

5. Method of producing anisotropic magnet powders as set forth in claim 4, wherein said reverse transformation is introduced under constant temperature by compensating the heat absorbed by endothermic reaction.

6. Method of producing anisotropic magnet powders as set forth in claim 1, wherein heat treatment in a vacuum is carried out at 780–840° C. for at least 25 minutes to eliminate the residual hydrogen in said R—Fe—B based alloy completely and cooling the alloy after said heat treatment in vacuum.

* * * * *